United States Patent [19]

Struzik et al.

[11] Patent Number: 4,991,825

[45] Date of Patent: Feb. 12, 1991

[54] INJECTION DEVICE

[75] Inventors: Erich Struzik, Solingen; Herbert Wagner, Dillingen; Dirk Stein, Höhr-Grenzhausen, all of Fed. Rep. of Germany

[73] Assignee: Plibrico Co. GmbH, Düsseldorf, Fed. Rep. of Germany

[21] Appl. No.: 453,661

[22] Filed: Dec. 20, 1989

[30] Foreign Application Priority Data

Dec. 22, 1988 [DE] Fed. Rep. of Germany ..... 3843149
Mar. 8, 1989 [DE] Fed. Rep. of Germany ..... 3907383

[51] Int. Cl.[5] ..... C21C 5/48
[52] U.S. Cl. ..... 266/218; 266/217; 266/265
[58] Field of Search ..... 266/218, 265, 217

[56] References Cited

U.S. PATENT DOCUMENTS 3,971,548 7/1976 Folgero ..... 266/265
4,438,907 3/1984 Kimura ..... 266/217

*Primary Examiner*—Peter D. Rosenberg
*Attorney, Agent, or Firm*—Michael J. Striker

[57] ABSTRACT

An injection device for introducing gases into metallurgical vessels includes a gas sink with a plurality of gas-carrying ducts and formed as a refractory frustum, a metal layer enclosing an outer generated surface of the gas sink and its base area, a gas supply pipe exposed at a center of the metal-coated base area of the gas sink ad supplying gas to the gas-carrying ducts, and a perforate block enclosing the metal-coated generated surface of the gas sink. The upper end of the gas sink is not enclosed by the perforate block, extends beyond the lining of the ladle bottom into the inside of the ladle, and is surrounded by refractory material.

11 Claims, 1 Drawing Sheet

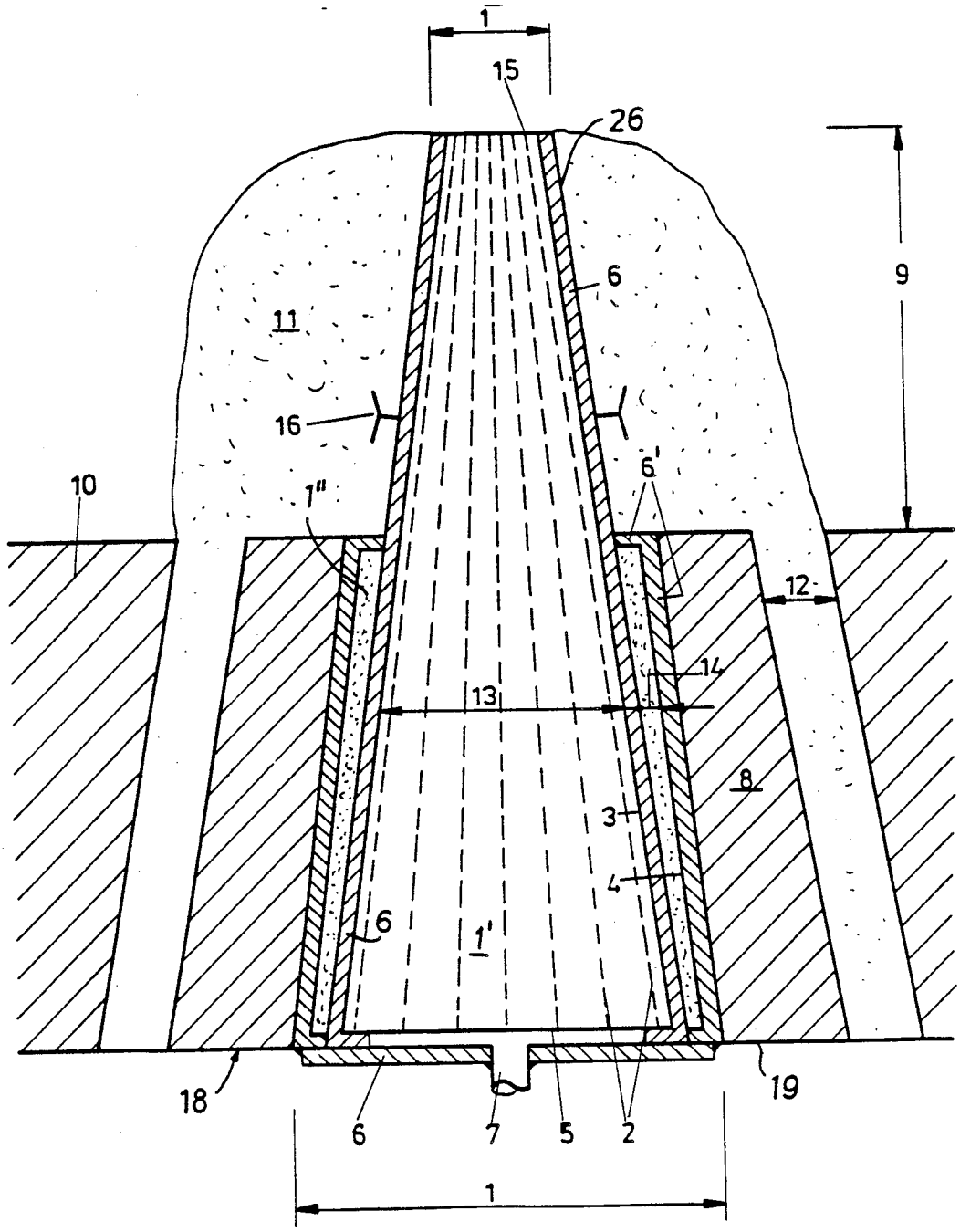
1
15
26
9
6
11
16
6'
10
1"
12
14
13
8
3
4
6
1'
18
19
6
7
5
2
1

INJECTION DEVICE

BACKGROUND OF THE INVENTION

The invention relates to a device with enhanced durability for injecting gases into metallurgical vessels.

Injection devices are used in different fields of industry. For example, they are used in metallurgical vessels and metal melts, for the introduction of gases or finely divided solids into a liquid. Often they are refractory gas sinks formed with ducts through which the gases or finely divided solids flow into the liquid. Gas sinks are known, for example, from German No. OS 36 25 478, German No. OS 36 42 623, German No. OS 36 31 521, German Patent Specifications No. U 85 22 350, 86 20 206 and 87 16 110 and European Patent A No. 0 153 380.

Normally gas sinks of the kind specified have a metal jacket and as a rule are provided with a separate envelope and inserted in perforate blocks. The cover area of the sinks is exposed to heavy wear, so that the blocks are continuously worn away, starting from the surface. Moreover, turbulences of the melt cause heavy wear between the metal layer, the envelope, the perforate block and the adjoining ladle bottom. The durability of such systems is therefore very limited.

SUMMARY OF THE INVENTION

It is an object of the invention to provide a slower-wearing injection device having at least 5 times the durability of conventional injection devices for the introduction of gases into metallurgical vessels.

This object and others are achieved in an injection device, comprising:

(a) a gas sink (1) formed with gas-carrying ducts (2) and constructed as a circular frustum of refractory material, (b) a metal layer (6) enclosing the outer generated surface of the gas sink and its base area (5), (c) a gas supply pipe (7) disposed at the centre of the metal-coated base area (5) of the gas sink (1), (d) a perforate block (8) enclosing the metal-coated generated surface of the gas sink (1).

According to the invention the upper end of the frustum of the gas sink which is not enclosed by the perforate block extends beyond the lining of the ladle bottom into the inside of the ladle, and the perforate block and the gas sink disposed therein are provided with an outer envelope of cast or rammed refractory material. Preferably the refractory material also fills the gap between the lining of the ladle bottom and the perforate block.

The hitherto unknown step according to the invention, namely of making the gas sink extend beyond the ladle bottom into the inside of the ladle, this part being given an additional envelope of refractory material which preferably extends into the gap between the perforate block of the sink and the lining of the ladle bottom, where it forms an anchoring, considerably enhances the durability of the gas sink, since slag residues inevitably deposited and collecting at the bottom on the emptying of the ladle do not settle on the gas sink. Hitherto the residual slag remaining on the ladle bottom clogged up the gas sinks disposed flush with the ladle bottom. The material became cold and stuck to the gas sink. As a result, the mouth of the gas sink had to be fired to free it before the ladle was used again. This meant not only additional labour, but also led to unnecessary additional wear on the gas sink.

The circular frustoconical gas sink preferably consists of two chambers separated from one another by a gas tight layer. Conveniently metal is used for this purpose. A zone in which no gas is carried is provided in the area of the generated surface of the circular frustum. The chamber which does not carry gas encloses a gas-carrying chamber formed with continuous ducts extending from the base area of the circular frustum to the cover area. Gas permeability can however also be achieved by other means, for example, by undirected porosity, directed gas permeability, the introduction of slots or ducts of a different kind. The generated surface of the sink can also be formed with ducts or raised portions, as known from so-called edge sinks.

Ducts can be produced in blocks of refractory materials by various methods. For example, granular refractory material can be introduced into a mould with needles or cores and compacted therein by ramming, shaking, vibration or pressing.

Methods of producing pores and ducts in refractory materials are known, for example, from German No. OS 25 11 997, European Patent Specification No. 0 083 919 and Austrian Patent Specifications No. 88 860 or 248 936.

The metal-coated gas sink is so inserted into a perforate block that the upper end of the circular frustum extends out of the perforate block and into the inside of the ladle. Preferably the sink is so constructed that only the inner, gas-carrying chamber extends out, and is not enveloped by the perforate block. In that case the outer chamber which does not carry gas has preferably the same height as the perforate block.

According to the invention the perforate block and the exposed end of the frustoconical gas sink are provided with an additional outer envelope of refractory material. This envelope is produced by the gap between the lining of the ladle bottom and the perforate block first being filled by the casting of refractory material, this layer then being compacted. Compacting can be performed, for example, by ramming, pouring or vibration. A self-compacting material can also be used. When the gap is filled with refractory material, the end of the frustoconical gas sink projecting beyond the perforate block is coated with the refractory material.

The metal layer, which engages around the exposed end of the circular frustoconical gas sink, is preferably provided with attaching elements, so that the outer envelope of refractory material adheres perpendicularly firmly. Suitable attaching elements include split pins, shaft stays, V stays and weld beads. However, other attaching elements are also suitable. For example, the metal jacket can have raised portions.

The invention will now be explained in greater detail with reference to the drawing.

BRIEF DESCRIPTION OF THE DRAWING

The single FIGURE of the drawing is a view schematically showing an injection device of the invention.

DESCRIPTION OF THE PREFERRED EMBODIMENTS

A circular frustoconical gas sink 1 is inserted in a perforate block 8. The circular frustoconical gas sink 1 comprises two chambers. A chamber 13 carries gas, while an outer chamber 14 does not carry gas. The gases are conducted from the base area 5 to the cover area 15 of the frustum via ducts 2 in the chamber 13. The circular frustoconical gas sink 1 comprises the gas-carrying chamber 13 only in its upper end part 9. This portion of the chamber is enclosed by a metal jacket 6, but it is no longer enclosed by the perforate block 8 and extends beyond the ladle bottom into the inside of the ladle.

The circular frustoconical gas sink 1 is provided with a metal jacket 6 over its whole generated surface and its base area 5. The metal jacket 6, which separates the chambers 13, 14 from one another, is also disposed between the gas-carrying chamber 13 and the non-gas-carrying chamber 14, which encloses the chamber 13 concentrically and forms an intermediate layer between the perforate block 8 and the gas-carrying chamber 13. The cover area 15 is not counted.

A gas supply pipe 7 is disposed in the centre of the base area 5 of the gas sink. Gas is supplied to the gas sink 1 via the pipe 7 and flows through the sink 1 via the ducts 2.

With the exception of the cover area 15 and the base area 5, the gas sink 1 and the perforate block 8 are completely coated with an envelope 11 of refractory material. The refractory material introduced into the gap 12 between the perforate block 8 and the lining 10 of the ladle bottom and is filled in as far as the cover area 15 of the sink. In the upper end part 9 of the frustum the metal jacket is equipped with attaching elements 16, which anchor the outer envelope 11.

An injection device constructed in this way protects the surface of attack against turbulances of the melt to such an extent that wear is considerably reduced, since with the ordinary prior art injection devices, heavy melt turbulances cause heavy wear between the metal layer, the envelope, the perforate block and the adjoining blocks of the ladle bottom. The invention obviates these disadvantages, so that durability is at least 5 times that of the prior art devices, thereby outlasting even one complete ladle campaign. The common metal envelope around both chambers of the gas sink 1 also ensures the operationally reliable interchanging of the gas sinks without damage to the perforate block.

We claim:

1. A device for injecting gases into metallurgical vessels, comprising:

(a) a gas sink (1) formed as a circular frustum of refractory material and having a base area (5), a cover area (15) and a plurality of through-going gas-carrying ducts (2) extending through the gas sink between the base area (5) and the cover area (15), the circular frustrum having an outer generated surface, (b) a metal layer (6) enclosing the outer generated surface of the gas sink and the base area (5), (c) a gas supply pipe (7) disposed at the centre of the metal-coated base area (5) of the gas sink (1) for supplying gas to the gas-carrying ducts (2), (d) a perforate block (8) enclosing the metal-coated generated surface of the gas sink (1), (e) an upper end part (9) of the frustum of the gas sink (1) being not enclosed by the perforate block (8) and extending beyond a lining (10) of a ladle bottom into the inside of a ladle, and (f) the perforate block (8) and the gas sink (1) with the upper end part (9) being provided with an outer envelope (11) of refractory material, so that due to the extension of the upper end part of the frustrum of the gas sink beyond the lining of the ladle bottom into the inside of the ladle durability of the gas sink is enhanced by preventing settling of slag residues, which are deposited and collected at the ladle bottom on the emptying of the ladle, on the gas sink.

2. An injection device according to claim 1, wherein the gas sink (1) comprises two circular frustums which are superimposed on one another, one of them concentrically enclosing the other one, with the formation of a gas-carrying chamber (13) and a chamber (14) which does not carry gas and is disposed on the outer zone of the generated surface of the gas sink (1), continuous ducts (2) extending in the gas-carrying chamber (13) from the base area (5) to the cover area (15) of the circular frustum.

3. An injection device according to claim 2, wherein the gas sink (1) has chambers (13, 14) separated from one another by a metal layer (6).

4. An injection device according to claim 1, wherein the envelope (11) fills a gap (12) between the lining (10) of the ladle bottom and the perforate block (8).

5. An injection device according to claim 1, and further comprising attaching elements (16) for the outer envelope (11) disposed on the metal layer (6) in the upper end part (9) of the frustrum not enclosed by the perforate block (8).

6. An injection device according to claim 5, wherein the attaching elements (16) are split pins.

7. A method of manufacturing the injection device according to claim 1, characterized in that the refractory material (11) is filled in as far as a cover surface (15) of the gas sink (1).

8. A metallurgical vessel, comprising a ladle having a ladle bottom with a lining (10); and a device for injecting gases into the vessel, said device including a gas sink (1) formed as a circular frustum of refractory material and having a plurality of throughgoing gas-carrying ducts (2) extending from its base area (5) to its top area, a metal layer (6) enclosing an outer generated surface of the gas sink (1) and the base area (5), a gas supply pipe (7) exposed at a center of the metal-coated base area (5) of the gas sink (1) for supplying gas to the gas-carrying ducts (2), a perforate block (8) enclosing the metal-coated generated surface of the gas sink (1), an upper end of the frustum of the gas sink (1) which is enclosed by the perforated block (8) extending beyond the lining (10) of the ladle bottom into the inside of the ladle, and a perforate block (8) and the gas sink (1) disposed therein being provided with an outer envelope of refractory material, so that due to the extension of the upper end part of the frustrum of the gas sink beyond the lining of the ladle bottom into the inside of the ladle durability of the gas sink is enhanced by preventing settling of slag residues, which are deposited and collected at the ladle bottom on the emptying of the ladle, on the gas sink.

9. An injection device according to claim 5, wherein the attaching elements (16) are shaft stays.

10. An injection device according to claim 5, wherein the attaching elements (16) are V stays.

11. An injection device according to claim 5, wherein the attaching elements (16) are weld bands.

* * * * *
* * * * *